US006772964B2

(12) United States Patent
Funseth et al.

(10) Patent No.: US 6,772,964 B2
(45) Date of Patent: Aug. 10, 2004

(54) SPRAYER FLOOD TIP AND NOZZLE BODY ASSEMBLY

(75) Inventors: Travis G. Funseth, Ankeny, IA (US); Kent Alvin Klemme, Ankeny, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/228,350

(22) Filed: Aug. 26, 2002

(65) Prior Publication Data

US 2004/0046054 A1 Mar. 11, 2004

(51) Int. Cl.[7] ..... B05B 1/34

(52) U.S. Cl. ..... 239/436; 239/390; 239/391; 239/392; 239/393; 239/394; 239/396; 239/397

(58) Field of Search ..... 239/390, 391, 239/392, 393, 394, 396, 397, 436

(56) References Cited

U.S. PATENT DOCUMENTS

| | | | | | |
|---|---|---|---|---|---|
| 3,385,525 | A | * | 5/1968 | Jacobs | 239/394 |
| 4,058,260 | A | * | 11/1977 | Lestradet | 239/394 |
| 4,353,508 | A | * | 10/1982 | Butterfield et al. | 239/590.3 |
| 5,082,183 | A | * | 1/1992 | Dahlin et al. | 239/393 |
| 5,125,578 | A | * | 6/1992 | Ballu | 239/394 |
| 5,738,705 | A | * | 4/1998 | Anderson et al. | 75/332 |
| 5,884,847 | A | * | 3/1999 | Christopher | 239/390 |
| 2002/0190140 | A1 | * | 12/2002 | Arenson et al. | 239/391 |

OTHER PUBLICATIONS

Richway, Airpinch Valves brochure, 2 pages, publication date—unknown, published in U.S.A.

Richway, Nozzle Stop brochure, 2 pages, publication date—unknown, published in U.S.A.

Banjo, "The Original Yellow Handle" brochure, 3 pages, publication date—unknown, published in U.S.A.

Spraying Systems Co., TeeJet Agricultural Spray Products Catalog 47A, 6 pages, publication date—1999, published in U.S.A.

Precision Fitting & Valve Co., Agricultural & Industrial Spraying Products Guide, 5 pages, publication date—2000, published in U.S.A.

* cited by examiner

*Primary Examiner*—Robin O. Evans

(57) ABSTRACT

A nozzle assembly includes a plastic, one-piece flood tip that attaches directly over the bayonet connector of a nozzle body. The nozzle body is of the diaphragm type for reduced weight, cost and complexity but modified to increase flow capacity. In one embodiment, a 90-degree bayonet is provided on the nozzle body turret, and other bayonet selections are also available on the turret for flat fan spray patterns. In a second embodiment, a conventional radially extending bayonet pattern is provided, and the flood tip itself is fabricated with a 90-degree turn. The plumbing system utilized for high spray rate applications with the flood tip is the same as for lower rate spraying using a different tip mounted on other bayonet connector on the turret.

14 Claims, 3 Drawing Sheets

SPRAYER FLOOD TIP AND NOZZLE BODY ASSEMBLY

FIELD OF THE INVENTION

The present invention relates generally to agricultural sprayers and, more specifically, to flood tips and nozzle bodies for such sprayers.

BACKGROUND OF THE INVENTION

Agricultural sprayers require numerous spray nozzles changing spray characteristics in accordance conditions. For example, a variety of spray rates, spray droplet sizes and spray patterns must be accommodated. When relatively high spray rates (2.0 to 10.0 gallons per minute) and large droplet sizes are required, operators typically use a flood tip nozzle having a tip with a notch or cut-away secured in position by a cam lock adapter having two cam arms. The cam lock adapter is usually assembled into a pinch valve style nozzle body and can require a second conduit system. The pinch valve body requires a complicated and expensive pneumatic control system which includes numerous control lines which have to be routed along the sprayer boom. Compared to low to medium rate boom plumbing configurations, the high flow systems require more boom space and weight. The increased weight, complexity, boom space, and cost of flood tip nozzle systems have continued to be problematic.

For low to medium rate systems (0.1 to 2.0 gallons per minute), operators typically use a less complex and less expensive diaphragm type nozzle body which is responsive to fluid pressure in the supply line for turning flow to the nozzle tip on and off. The diaphragm type body does not require a control line and usually has a turret including bayonet style ends that receive the tips and twist-on caps that secure the tips to the body. The turret provides the flexibility to change to a different nozzle tip by turning the turret to a different bayonet position. Such nozzle bodies heretofore have not been readily adaptable for use with flood tips. Providing an adapter for joining a flood tip nozzle to the nozzle body adds weight and increases space requirements. The added weight tends to overload the nozzle body, and the added space requirements can limit boom folding ability. An adapter also provides opportunity for an operator to use stainless steel tips, which also add too much weight and overload the nozzle bodies. Further, the limited flow capacity of existing diaphragm type nozzle bodies has not provided sufficient flow for flood tip operation.

In many cases an operator wants both high and low spray rate capability in a single piece of equipment to handle varying situations throughout the season. In the past, manufacturers have had to offer double plumbing configurations to handle a wide range of spray rates. A double plumbing configuration includes two stand-alone plumbing setups, one which uses the diaphragm nozzle body and one which uses the pinch valve style nozzle body. Each setup usually has separate spray pipes, feed systems and control systems and adds substantial cost, complexity, weight and space requirements to the sprayer.

SUMMARY OF THE INVENTION

It is therefore an object of the present invention to provide an improved flood tip nozzle assembly. It is another object to provide such a nozzle assembly which overcomes most or all of the aforementioned problems.

It is another object to provide an improved flood tip nozzle assembly which is lighter, less complex and expensive, and requires less boom space than at least most previously available flood tip nozzles. It is a further object to provide such a nozzle assembly which eliminates the need for an adapter that could also be used to attach heavier tips such as stainless steel tips.

It is a further object of the present invention to provide an improved flood tip nozzle assembly which eliminates the need for a pinch valve style of nozzle body and the associated complex pneumatic system. It is yet another object to provide such an assembly which allows use of high flow flood nozzles on diaphragm nozzle bodies with bayonet style ends. It is also an object to provide full range spray system rates on the order of 0.1 to 10.0 gallons per minute without need for double plumbing.

A nozzle assembly constructed in accordance with the teachings of the present invention includes a plastic flood tip that connects directly over the bayonet of a nozzle body. The tip serves the functions of both the flood tip and the cap that secures the tip to the body. In the preferred embodiment, the nozzle body is of the diaphragm type with an enlarged, higher capacity valve area for reduced weight, cost and complexity and elimination of complex pneumatic controls and double plumbing lines. In one embodiment, a 90-degree bayonet is provided on the nozzle body turret, and other bayonet selections are also available on the turret for flat fan spray patterns.

In a second embodiment, a conventional radially extending bayonet pattern is provided, and the flood tip itself is fabricated with a 90-degree turn. The turret is simpler in design, and the flood tip still retains the one-piece tip and cap design that connects directly over the bayonet.

By eliminating the need for a cam lock adapter, the assembly is lighter and less complex and costly than conventional assemblies. The potential for adding too much weight to the nozzle body is reduced or eliminated. Double plumbing is obviated, and weight, complexity, boom space requirements, and cost of the spray system are lessened compared to at least most previously available full range systems.

These and other objects, features and advantages of the present invention will become apparent from the drawings and detailed description which follows.

DESCRIPTION OF THE PREFERRED EMBODIMENT

Figure 1:
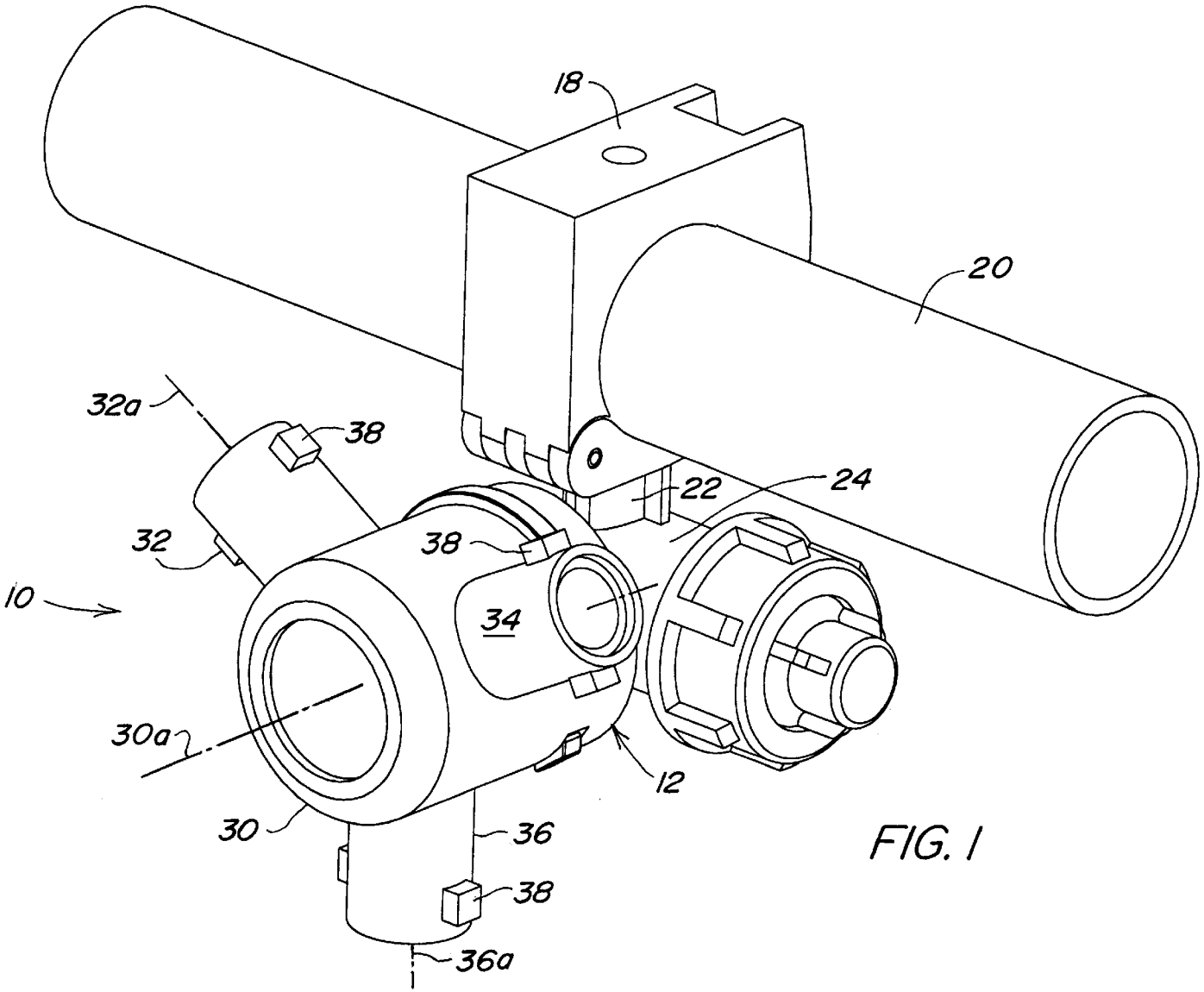
FIG. 1 is a perspective view of a diaphragm type nozzle body on a supply line, the body including a turret with a plurality of bayonet connectors.

Referring to FIG. 1, therein is shown a portion of a nozzle assembly 10 for an agricultural sprayer or the like. The nozzle assembly 10 as shown is a diaphragm type generally of conventional construction having a body 12. A connector 18 secures the body 12 to a fluid supply line 20 connected to a source of pressurized fluid to be sprayed (not shown) located on the sprayer. A fluid inlet area 22 opens into the supply line 20 and into a diaphragm valve area 24 controlled by the fluid pressure at the inlet area. The valve area 24 is constructed with a larger diaphragm and inlet area than are commonly available on a conventional diaphragm type body to increase flow capacity to at least several times that normally available in such a valve. A turret 30 is rotatably mounted on the body for rotation about a generally horizontal turret axis 30*a* and includes a plurality of radially projecting bayonet connectors 32, 34 and 36, each with opposed bayonet projections 38. Different nozzles can be attached to the bayonet connectors. When one of the bayonet connectors 32–34 is rotated to a downwardly directed position, that connector is placed in fluid communication with the valve area 24. Applying spray fluid to the inlet 22 at a pressure above the cut-off pressure of the valve, typically on the order of ten psi, causes the valve to open and pressurized spray fluid to be directed from the supply line 20 through the valve area 24 and downwardly directed bayonet connector for application by an attached tip. As the fluid pressure drops below the cut-off pressure, the valve closes to completely cut off flow to the nozzle.

Figure 2:
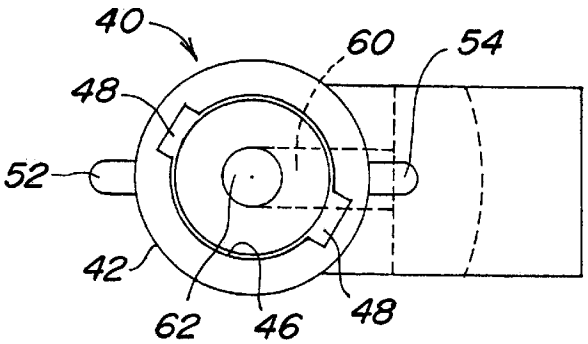
FIG. 2 is a top view of a one-piece flood tip nozzle and cap structure with a 90-degree turn conduit adapted for positioning on one of the radially extending bayonet connectors of the turret of FIG. 1.
Figure 3:
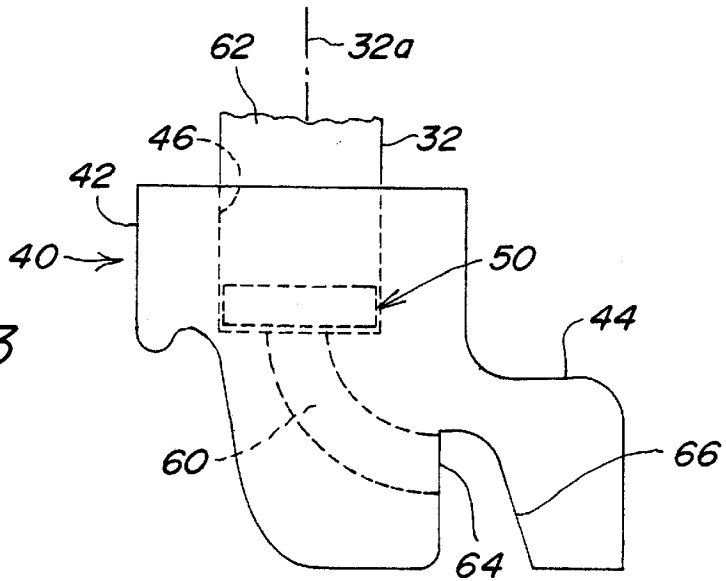
FIG. 3 is a side view of the nozzle and cap structure of FIG. 2.
Figure 4:
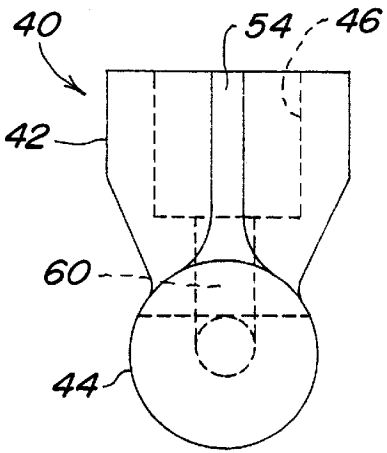
FIG. 4 is a front view of the structure of FIG. 3.

Referring to FIGS. 2–4, therein is shown a simplified flood nozzle 40 which preferably is a one-piece structure fabricated from a non-metallic material such as plastic. The flood nozzle 40 includes an upwardly opening cap or attaching portion 42 and a downwardly directed tip portion 44. A generally annular opening 46 with bayonet passages 48 in the attaching portion 42 is matingly received over the first connector 32 and projections 38 and is rotated several degrees to secure the nozzle in position on the connector 32. A seal 50 provides a fluid-tight connection between the connector 32 and the nozzle 40. The attaching portion 42 includes opposed ears 52 to aid in twisting the nozzle 40 onto the bayonet connector 32.

The nozzle 40 includes a fluid passageway 60 having an inlet portion 62 in fluid communication with the connector 32 and an outlet portion 64 defining an outlet port opening in a direction angled approximately 90 degrees from the radial direction, the radial direction being generally in the direction of the axis of the connector 32. A deflector 66 intercepts fluid, which flows generally horizontally from the outlet port, and directs the fluid downwardly or generally in the radial direction. A relatively large volume of spray fluid can be directed through the flood tip nozzle 40 using a conventional turret and a light nozzle design, and the nozzle 40 can be used with a diaphragm type nozzle body.

Figure 5:
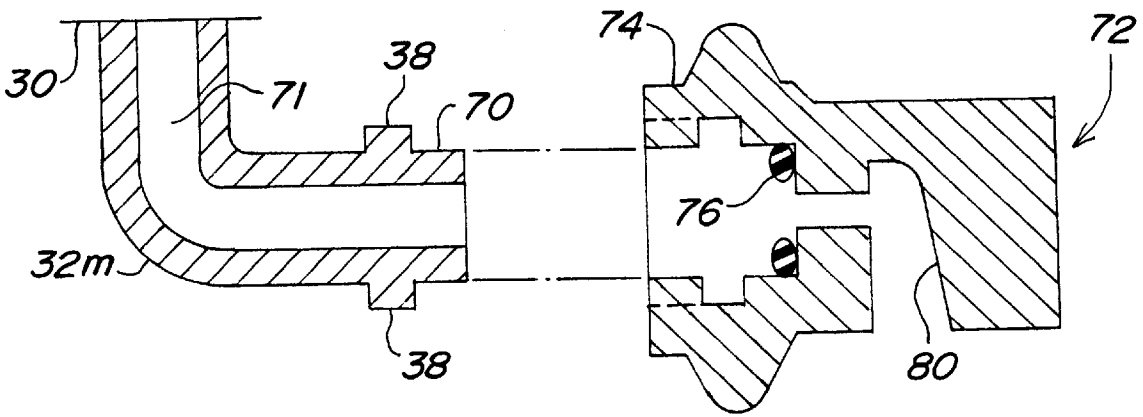
FIG. 5 is a view, partially in section, of a portion of modified turret having one bayonet turned from the radial direction for receiving a straight conduit flood tip nozzle.
Figure 6:
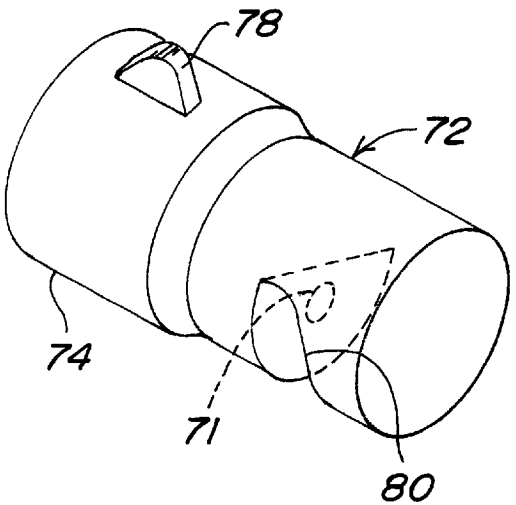
FIG. 6 is a perspective view of the flood tip nozzle used with the 90-degree bayonet of FIG. 5.

In the embodiment shown in FIGS. 5 and 6, the turret 30 includes a modified bayonet connector 32*m* having a connecting end 70 extending generally horizontally or in the direction of the turret axis 30*a* for receiving a flood tip nozzle 72. The connector 32*m* has a passageway 71 with a radially extending upstream end and a horizontally extending downstream end opening into the nozzle 72. Other connectors are of conventional construction and extend radially (see, for example, axis 36*a* of the connector 36 in FIG. 1) for receiving tips of substantially less capacity than that of the flood tip nozzle 72.

The nozzle 72 includes a connecting end 74 adapted for receipt by the connecting end 70. A seal 76 engages the end 70 to provide fluid-tight connection between the nozzle 72 and the passageway 71 of connector 32*m* when the nozzle is twisted into the locked position relative to the projections 38. Ears or projections 78 on the end 74 provide a gripping area for aiding the operator in removal and attachment of the nozzle 72. A deflector 80 intercepts the horizontal stream of spray fluid passing through the nozzle 72 and directs the stream downwardly toward the ground in a fan pattern. The nozzle 72 is preferably fabricated as a unitary structure from a lightweight material such as plastic.

Having described the preferred embodiment, it will become apparent that various modifications can be made without departing from the scope of the invention as defined in the accompanying claims.

What is claimed is:

1. A nozzle assembly for a sprayer comprising:

a body in fluid communication with a single supply line providing a source of pressurized spray fluid to the body at a rate up to about 10 gallons per minute;

a turret connected to the body for rotation about a turret axis, the turret including at least first and second spray tip-receiving connectors for receiving spray tips of differing spray tip capacities in a range from about 0.1 gallons to 10 gallons per minute; and a high spray capacity flood tip nozzle matingly received by the first connector, wherein the turret is rotatable for selecting spray fluid flow through the high spray capacity flood tip nozzle, the flood tip nozzle having a spray capacity substantially greater than 2 gallons per minute, and lower capacity nozzle received by the second connector having a spray capacity less than 2 gallons per minute, wherein the turret is rotatable for selecting spray fluid flow through the lower capacity nozzle and the first and second connectors extend radially from the turret.

2. A nozzle assembly for a sprayer comprising:

a body adapted for connection to a source of pressurized spray fluid;

a turret connected to the body for rotation about a turret axis, the turret including at least first and second spray tip-receiving connectors for receiving spray tips of differing spray tip capacities;

a high spray capacity flood tip nozzle matingly received by the first connector, wherein the turret is rotatable for selecting spray fluid flow through the high spray capacity flood tip nozzle; and wherein first connector opens outwardly in a radial direction, and the flood tip nozzle includes a passage angled with respect to the radial direction to direct spray fluid generally in the direction of the turret axis.

3. The nozzle assembly as set forth in claim 1 wherein the flood tip nozzle includes a passageway with an outlet port opening generally horizontally, and wherein the first connector opens in a direction generally parallel to the turret axis and into the passageway, and wherein the flood tip nozzle includes a deflector intercepting fluid from the outlet port and directing the fluid downwardly.

4. The nozzle assembly as set forth in claim 1 wherein the flood tip nozzle is of single one-piece, non-metallic construction.

5. The nozzle assembly as set forth in claim 1 including a first tip of first spray capacity in the range of 0.1 to 2.0 gallons per minute and wherein the high capacity flood tip nozzle includes a tip with capacity in the range of 2.0 to 10.0 gallons per minute.

6. The nozzle assembly as set forth in claim 1 wherein the body includes a diaphragm valve located between the source and the connectors for selectively controlling flow to the connectors, the diaphragm valve responsive to spray fluid pressure of the source for interrupting fluid flow to the flood tip nozzle when the pressure drops below a shut-off value.

7. The nozzle assembly as set forth in claim 1 wherein the first connector comprises a bayonet connector extending radially from the turret, and the flood tip nozzle comprises a one-piece non-metallic structure received by the bayonet connector independently of additional connecting structure.

8. A nozzle assembly for a sprayer comprising:

a body adapted for connection to a source of pressurized spray fluid;

a turret connected to the body for rotation about a turret axis, the turret including at least first and second spray tip-receiving connectors for receiving spray tips of differing spray tip capacities;

a high spray capacity flood tip nozzle matingly received by the first connector, wherein the turret is rotatable for selecting spray fluid flow through the high spray capacity flood tip nozzle; and wherein the flood tip nozzle includes a passageway having an inlet component extending generally radially and an outlet component angled from the inlet component in the direction of the turret axis, and a deflector directing flow from the outlet component in the radial direction.

9. A nozzle body for a flood tip nozzle assembly of an agricultural sprayer having a single fluid line, comprising:

a body portion including an inlet for connection to a source of spray fluid under pressure;

a turret connected to the body portion for rotation about a turret axis, the turret including a plurality of spray tip-receiving connectors for receiving spray tips of differing spray tip capacities, including a flood tip-receiving connector having a capacity in the range of 2.0 to 10.0 gallons per minute, wherein the turret is rotatable for selecting spray fluid flow through one of the connectors; and wherein the body portion includes a diaphragm type valve located between the inlet and the turret and responsive to the pressure of the spray fluid for stopping the fluid flow to the connectors when fluid pressure drops below a minimum pressure, the valve having a throughput capacity of greater than 2.0 gallons per minute, the single fluid line providing substantially all the fluid flow to a flood tip and control of the flow to the flood tip.

10. The nozzle body as set forth in claim 9 wherein the flood-tip receiving connector comprises a bayonet connector.

11. A nozzle body for a flood tip nozzle assembly of an agricultural sprayer, comprising:

a body portion including an inlet for connection to a source of spray fluid under pressure;

a turret connected to the body portion for rotation about a turret axis, the turret including a plurality of spray tip-receiving connectors for receiving spray tips of differing spray tip capacities, including a flood tip-receiving connector having a capacity in the range of 2.0 to 10.0 gallons per minute, wherein the turret is rotatable for selecting spray fluid flow through one of the connectors; and wherein the body portion includes a diaphragm type valve located between the inlet and the turret and responsive to the pressure of the spray fluid for stopping flow to the connectors when fluid pressure drops below a minimum pressure, the valve having a throughput capacity of greater than 2.0 gallons per minute, so that only a single fluid line is required to supply and control fluid flow to a flood tip; and wherein the flood-tip receiving connector comprises a connecting portion angled from a radial direction with respect to the turret.

12. A flood tip nozzle for a spray nozzle body of an agricultural sprayer having a connecting portion with an upright axis for directing pressurized fluid downwardly towards material to be sprayed, the nozzle comprising:

an inlet area adapted for mating connection with the connecting portion and having a first conduit portion extending generally in the direction of the upright axis and an outlet portion having a second conduit portion extending at an angle to the first conduit portion and providing a generally horizontal flow of the pressurized fluid outwardly from the second conduit portion;

a deflector located in the path of the generally horizontal flow to direct the pressurized fluid towards the material to be sprayed; and wherein the nozzle has a capacity in the range of 2.0 to 10.0 gallons per minute.

13. The nozzle as set forth in claim 12 wherein the inlet area includes a bayonet connection.

14. The nozzle as set forth in claim 13 wherein the inlet area includes projecting ears facilitating mounting of the nozzle on the connecting portion.

* * * * *